US005184104A

United States Patent [19]

Kondo

[11] Patent Number: 5,184,104

[45] Date of Patent: Feb. 2, 1993

[54] ELECTROMAGNETIC INDUCTION APPARATUS WITH A SOUND SUPPRESSING ARRANGEMENT

[75] Inventor: Katsumi Kondo, Ako, Japan

[73] Assignee: Mitsubishi Denki Kabushiki Kaisha, Tokyo, Japan

[21] Appl. No.: 538,093

[22] Filed: Jun. 13, 1990

Related U.S. Application Data

[62] Division of Ser. No. 302,416, Jan. 27, 1989, abandoned.

[30] Foreign Application Priority Data

Feb. 29, 1988 [JP] Japan ..... 63-48231

[51] Int. Cl.[5] ..... H01F 15/00

[52] U.S. Cl. ..... 336/100; 181/202; 181/294; 248/638

[58] Field of Search ..... 248/632, 633, 638; 181/198, 202, 207, 208, 299; 310/51; 336/100

[56] References Cited

U.S. PATENT DOCUMENTS

| | | | |
|---|---|---|---|
| 3,077,946 | 2/1963 | Wilkins | 336/100 |
| 3,309,639 | 3/1967 | Goolsby, Jr. | 336/100 |
| 4,215,763 | 8/1980 | Pasko | 181/202 |
| 4,318,068 | 3/1982 | Hori | 336/100 |
| 4,442,419 | 4/1984 | Kanoi et al. | 336/100 |
| 4,514,714 | 4/1985 | Kanoi et al. | 336/100 |

FOREIGN PATENT DOCUMENTS

| | | | |
|---|---|---|---|
| 45-11330 | 6/1966 | Japan | 336/100 |
| 52-226423 | 2/1977 | Japan | 336/100 |
| 55-39623 | 3/1980 | Japan | 336/100 |
| 55-156316 | 12/1980 | Japan | 336/100 |
| 58-34907 | 3/1983 | Japan | 336/100 |
| 59-182513 | 10/1984 | Japan | 336/100 |
| 826501 | 1/1960 | United Kingdom | 336/100 |

*Primary Examiner*—Thomas J. Kozma
*Attorney, Agent, or Firm*—Leydig, Voit & Mayer

[57] ABSTRACT

An electromagnetic induction apparatus includes a tank having a bottom plate and containing an electrical device which vibrates during operation. The tank is supported by supporting members disposed between the tank bottom plate and a floor surface to define spaces therebetween. Sound suppressing members are disposed in the spaces defined between the support members, the tank bottom plate, and the floor surface. The sound suppressing members absorb sounds generated within the spaces and prevent air within the spaces from resonating during vibration of the electrical device.

3 Claims, 5 Drawing Sheets

ELECTROMAGNETIC INDUCTION APPARATUS WITH A SOUND SUPPRESSING ARRANGEMENT

This application is a division of application Ser. No. 07/302,416, filed Jan. 27, 1989; now abandoned.

BACKGROUND OF THE INVENTION

This invention relates to an electromagnetic induction apparatus with a sound suppressing arrangement and, more particularly, to a sound suppressing arrangement for reducing the noise generated by an electromagnetic induction apparatus such as an electrical transformer.

FIG. 1 is a sectional view showing the conventional electromagnetic induction apparatus of this kind, in which reference numeral 1 designates an electrical coil assembly of an electromagnetic induction apparatus, 2 is an electrically insulating oil, 3 is a tank main body in which the coil assembly 1 is housed together with the insulating oil 2, 31 is a tank side plate constituting one portion of the tank main body 3, 32 is a tank bottom plate constituting one portion of the tank main body 3, 4 are reinforcing members for the tank side plate 31, 5 are sound shield members mounted to the reinforcing members 4, 6 are heavy objects attached to the sound shield members 5, 7 are reinforcing members for the tank bottom plate 32, 8 are electrical bushings connected to the coil assembly 1 mounted in the tank main body 3, 9 is a floor surface on which the electromagnetic induction apparatus is installed and 10 are spaces defined between the reinforcing members 7, the tank bottom plate 32 and the floor surface 9.

In this conventional design, the coil assembly 1 of the electromagnetic induction apparatus vibrates in all vertical and horizontal directions due to an electromagnetic force during normal operational conditions of the induction apparatus. This vibration is transmitted through the electrical insulating oil 2 to vibrate the tank main body 3, causing a noise.

Therefore, in order to reduce the noise generated by the vibration of the tank side plates 31, the sound absorbing member 5 is mounted to the reinforcing member 4 attached to the side plates 31 of the tank main body 3, and a heavy object 6 is additionally attached to the sound absorbing member 5 to improve the sound absorbing function of the sound absorbing member 5.

Since the conventional electromagnetic induction apparatus with a sound suppressing arrangement is designed as above-described, while the noise generated due to the vibration of the tank side plate 3 can be effectively reduced by the sound absorbing members 5 attached to the tank side plates 3, the noise generated by the tank bottom plate 32 and radiated from the space 10 defined between the reinforcing members 7, the bottom plate 32 and the floor surface 9 cannot be effectively reduced. Therefore, it has been necessary to provide a large scale sound insulating arrangement such as a sound shield wall or the like around the induction apparatus in order to effectively reduce the noise of the conventional electromagnetic induction apparatus.

SUMMARY OF THE INVENTION

This invention was made in order to solve the above-mentioned problems of the conventional electromagnetic induction apparatus, and accordingly one object of the present invention is to provide an electromagnetic induction apparatus in which the noise generated by the vibrating induction device is effectively suppressed.

Another object of the present invention is to provide an electromagnetic induction apparatus with a sound suppressing arrangement in which the noise generated by the vibration of the tank bottom plate and radiated from the spaces formed between the reinforcing members, the bottom plate and the floor surface is significantly suppressed.

A further object of the present invention is to provide an electromagnetic induction apparatus with a sound suppressing arrangement in which the noise generated by the vibration of the tank bottom plate is absorbed.

With the above objects in view, the electromagnetic induction apparatus with a sound suppressing arrangement of the present invention comprises a tank main body having a bottom plate and capable of being placed on a floor surface and containing therein an electrical device which vibrates during operation. The tank main body is supported by supporting members inserted between the tank bottom plate and the floor surface to define spaces therebetween, and a sound suppressing member is disposed in association with the space defined between the support members and between the tank bottom plate and the floor surface. The sound suppressing member may be a sound barrier member closing the space defined between the tank bottom plate and the floor surface or a sound absorbing or suppressing element disposed within the space.

By the sound shielding member or the sound suppressing element of the present invention, the noise generated in the space defined between the reinforcing members and the floor surface is absorbed or suppressed.

BRIEF DESCRIPTION OF THE DRAWINGS

The present invention will become more readily apparent from the following detailed description of the preferred embodiments of the present invention taken in conjunction with the accompanying drawings, in which.

DESCRIPTION OF THE PREFERRED EMBODIMENTS

Figure 1:
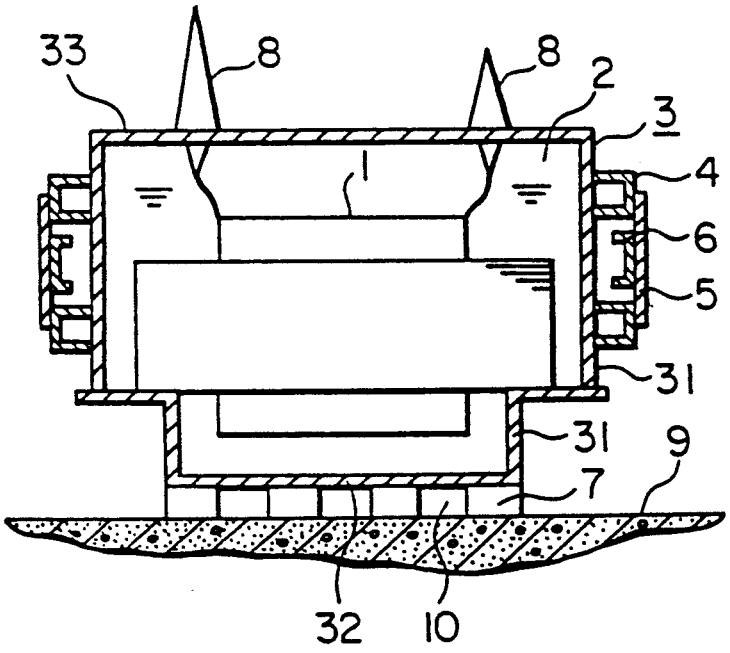
FIG. 1 PRIOR ART
FIG. 1 is a sectional view showing a conventional electromagnetic induction apparatus to which the present invention can be applied.
Figure 2:
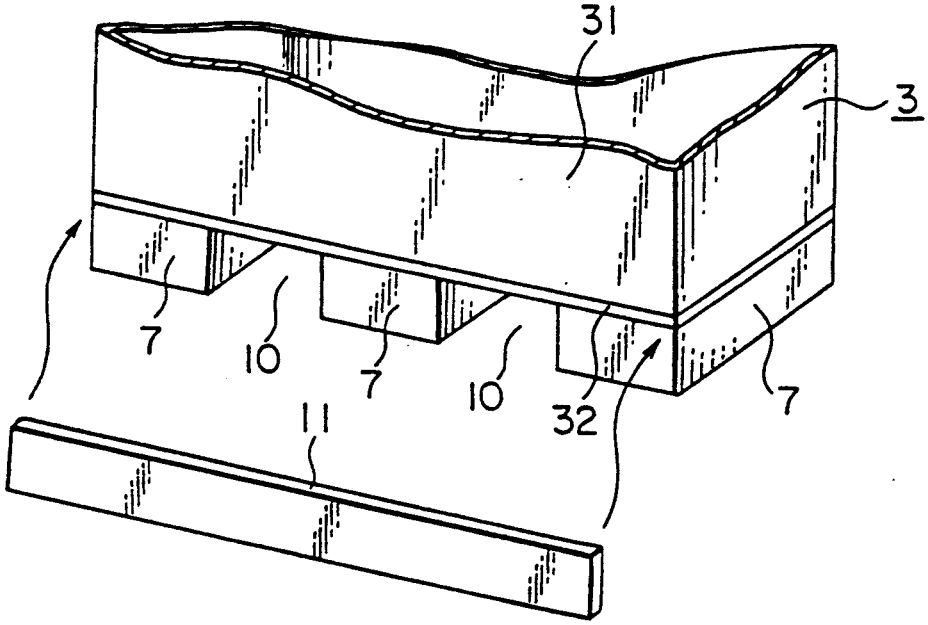
FIG. 2 is an exploded fragmental perspective view of the electromagnetic induction apparatus with the sound shield of one embodiment of the present invention.
Figure 3:
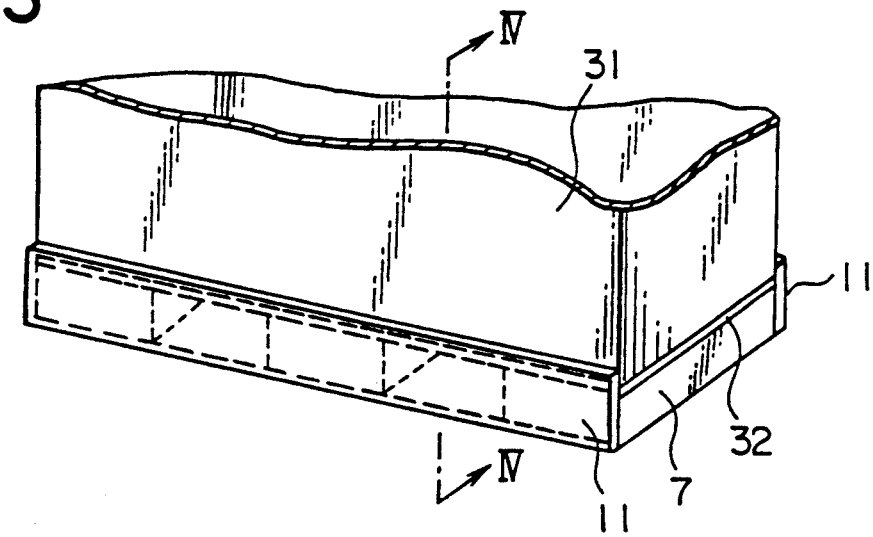
FIG. 3 is a fragment 1 perspective view of the sound shield shown in FIG. 2 attached to the electromagnetic induction apparatus.
Figure 4:
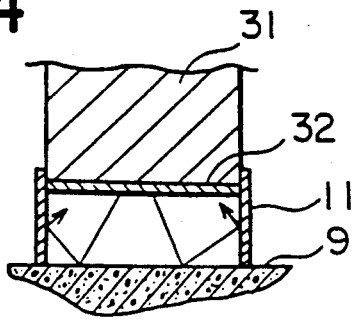
FIG. 4 is a schematic sectional view taken along line IV—IV of FIG. 3 for explaining the operation of this invention.
Figure 5:
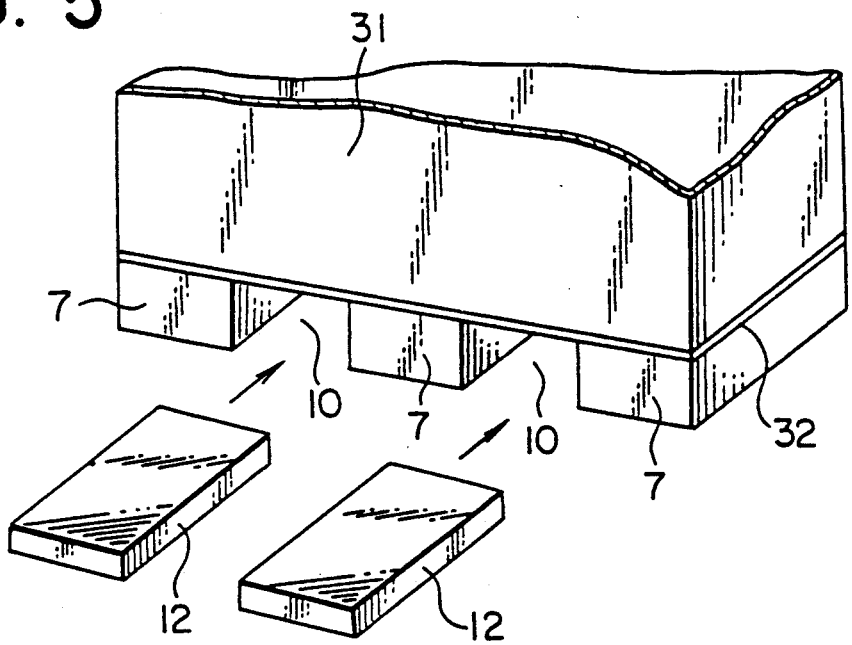
FIG. 5 is an exploded fragmental perspective view showing the electromagnetic induction apparatus with the sound shield of another embodiment of the present invention.
Figure 6:
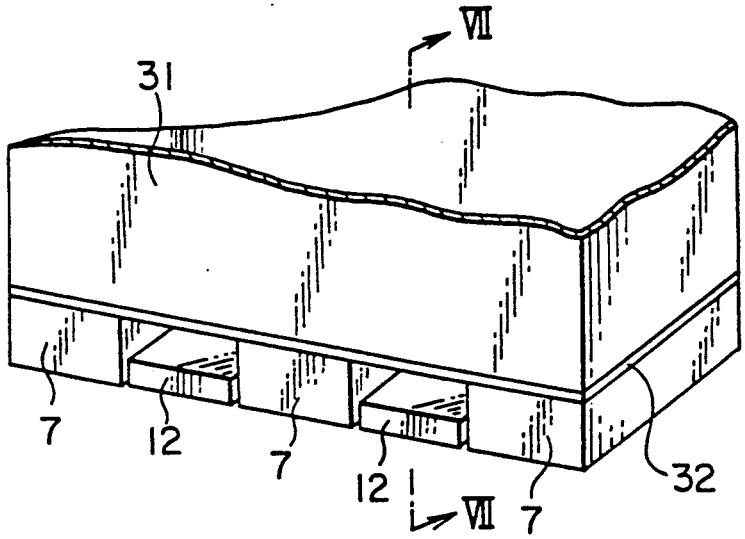
FIG. 6 is a fragmental perspective view of the sound shield shown in FIG. 5 attached to the electromagnetic induction apparatus.

FIGS. 2 to 4 illustrate an electromagnetic induction apparatus with a sound suppressing arrangement according to the present invention. It is seen that only a lower portion of the electromagnetic induction apparatus is illustrated for simplicity of explanation. The other portion of the electromagnetic induction apparatus not illustrated in FIGS. 2 to 4 is the same as that shown in FIG. 1 and accordingly, the illustrated electrical induction apparatus is an electrical transformer having an electrical coil assembly similar to the coil assembly 1 shown in FIG. 1.

The electromagnetic induction apparatus comprises a tank main body 3 having side walls 31, a bottom wall 32 and a top wall 33 (FIG. 1). As shown in FIG. 4, the bottom wall 32 is solid, i.e., it prevents insulting oil from passing therethrough to the outside of the tank main body 3. The tank main body 3 contains an electrically insulating oil 2 and an electrical device such as an electrical coil assembly 1 immersed in the insulating oil 2 and vibrates during operation.

In order to support the tank main body 3 from the floor surface 9, three supporting members 7 are inserted between the tank bottom wall 32 and the floor surface 9 to provide spaces 10 defined between the support members 7 and between the tank bottom wall 32 and the floor surface 9. In a preferred embodiment, the support members 7 are box-like or block-like members attached to the outer (lower) surface of the tank bottom wall 32.

According to the present invention, the electromagnetic induction apparatus comprises a sound barrier member 11 disposed in association with the spaces 10 defined between the support members 7 and between the tank bottom wall 32 and the floor surface 9. In the illustrated embodiment, the sound barrier member 11 is an elongated shield plate which is secured by welding for example at its upper side edge to the tank side wall 31 to close the spaces 10 against the exterior as best shown in FIGS. 3 and 4.

With the sound suppressing arrangement as above described, the noise generated by the vibration of the tank bottom plate 32 due to the vibration of the coil assembly 1 within the tank propagates in the space 10 as shown by arrows and is shielded and confined by the sound barrier member 11 within the spaces 10, so that the leakage of the noise to the exterior from the spaces 10 formed between the tank bottom plate 32 and the floor surface 9 is significantly reduced.

While this embodiment shown in FIGS. 2 to 4 employs the sound barrier members 11 by which the noise generated by the tank bottom wall 32 is shielded and confined by the sound shielding members 11 mounted to the tank bottom plate 32 or the tank side plate 31 in the vicinity of the tank bottom plate 32 to close the spaces 10 below the tank bottom wall 32, a similar sound suppressing effect can also be obtained by inserting a sound absorbing element into the spaces 10 defined between the support members 7 and between the tank bottom wall 32 and the floor surface 9.

FIGS. 5 to 8 illustrate one of such embodiments in which a sound absorbing material 12 in the form of a block of asbestos is inserted into each space 10 defined between the tank bottom wall 32 and the floor surface 9.

Figure 7:
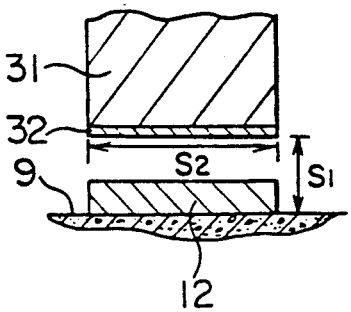
FIG. 7 is a schematic sectional view taken along line VII—VII of FIG. 6 for explaining the operation of this invention.
Figure 8:
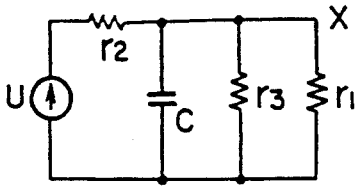
FIG. 8 is an acoustic circuit diagram for explaining the operation of this invention.

Referring to FIGS. 7 and 8, it is now assumed that the cross-sectional area of the outlet of the space 10 to the outside of the electromagnetic induction apparatus is $S_1$ and that the area of the surface of the tank bottom wall 32 exposed to the space 10 is $S_2$ as shown in FIG. 7, and an acoustic circuit is considered, then a constant flow sound source circuit as shown in FIG. 8 is obtained since the tank bottom wall has a very large impedance.

More particularly, in FIG. 8, a radiation impedance $r_1$ from the outlet cross-sectional area $S_1$ of the space 10 and a radiation impedance $r_2$ from surface area $S_2$ of the tank bottom wall 32 are connected in series with an acoustic source U, and an acoustic capacitance C of the space 10 and a resistance $r_3$ of the sound absorbing material 12 are connected in parallel to the impedance $r_1$.

With the structure of the above arrangement, since the resistance $r_3$ is connected in parallel with the radiation impedance $r_1$, the resultant impedance of $r_1$ and $r_2$ and the acoustic capacitance C is smaller than that when there is no resistance $r_3$, whereby the sound level at the point X or the noise radiated from the space outlet of the area $S_1$ is decreased.

Figure 9:
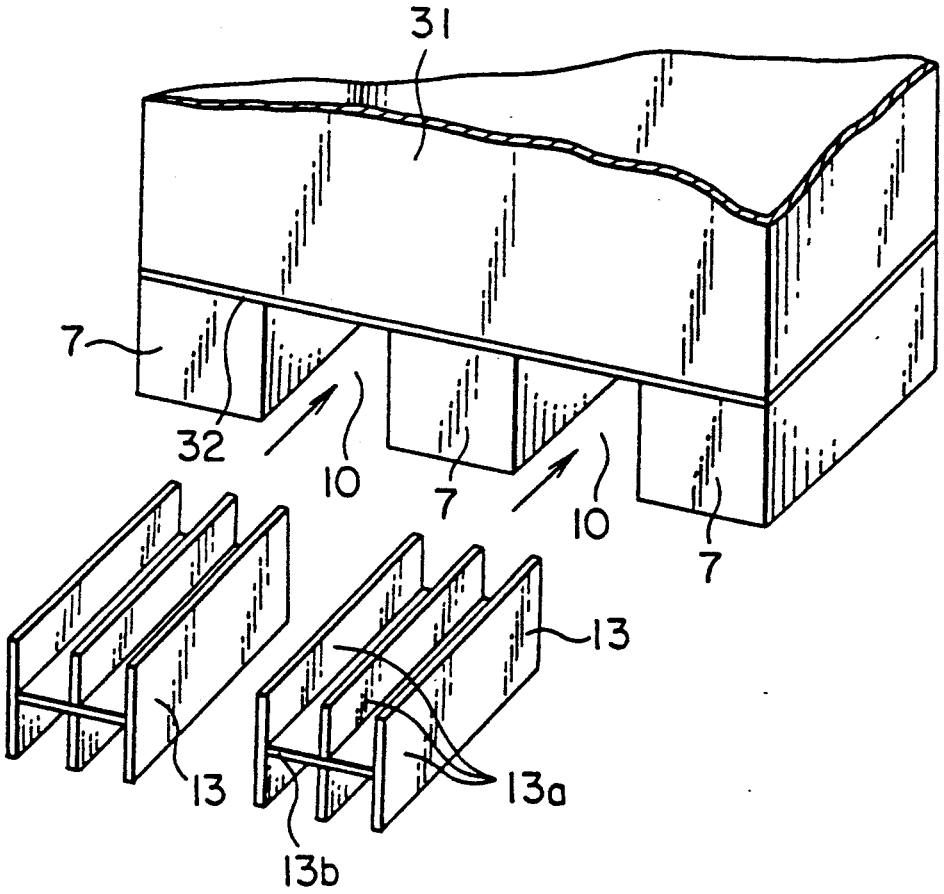
FIG. 9 is an exploded fragmental perspective view showing the electromagnetic induction apparatus with the sound absorbing elements of an embodiment of the present invention.
Figure 10:
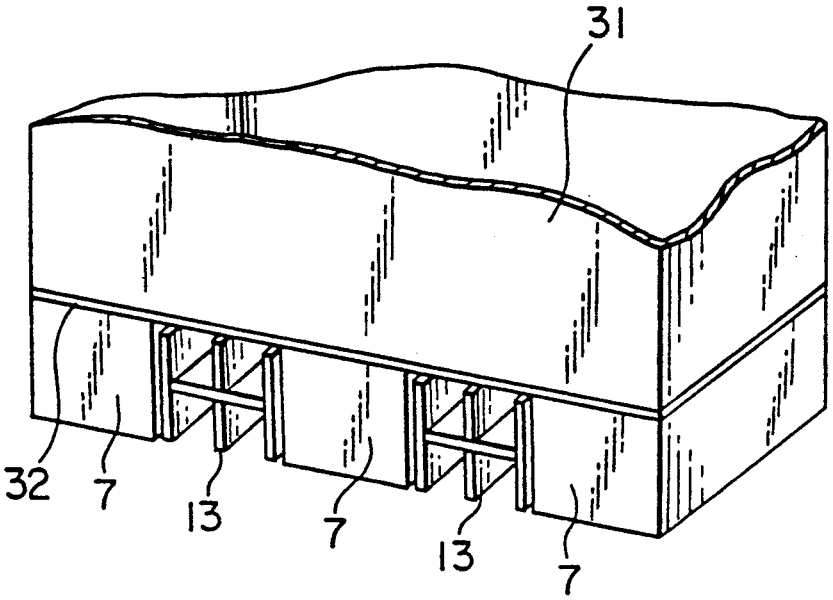
FIG. 10 is a fragmental perspective view of the sound absorbing elements shown in FIG. 9 assembled into the electromagnetic induction apparatus.

Also, when the distance between the bottom surface of the tank bottom wall 32 and the floor surface 9 exceeds a certain value which depends upon the frequency of the sound generated by the vibrating bottom wall 32, the air in the space 10 can resonate with the vibration of the tank bottom plate 32, causing the generated noise to become much larger than when no resonance occurs. Under such circumstances, the noise can be reduced by inserting a structural member 13 such as shown in FIGS. 9 and 10 into each of the spaces 10 formed between the support members 7 and under the tank bottom wall 32. The structural element 13 has three vertical rectangular plates 13*a* and one horizontal rectangular plate 13*b* supported at the center of the vertical plates 13*a* to provide a cross-sectional shape of a monogram composed of an "H" and an "I" crossing the horizontal leg of "H". The distance of the horizontal plate 13*b* relative to the tank bottom wall 32 is selected so that no resonance occurs when it is inserted into the space 10. The structural element 13 may be attached to the tank bottom wall 32.

Figure 11:
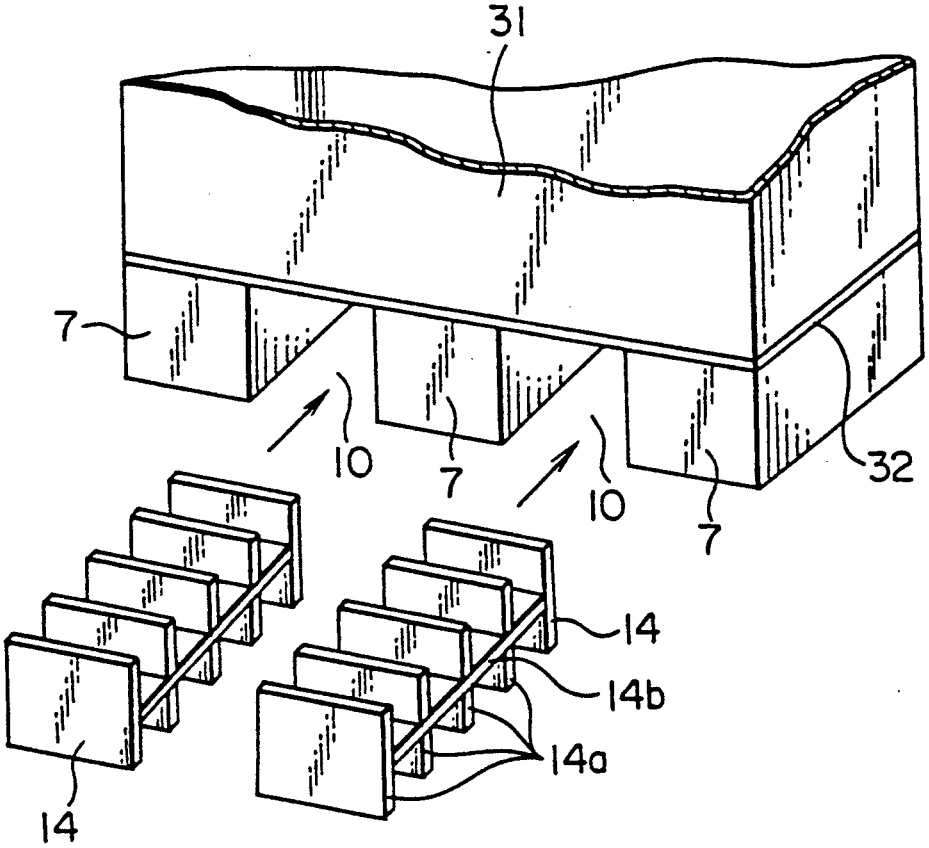
FIG. 11 is an exploded fragmental perspective view showing the electromagnetic induction apparatus with the sound absorbing elements of another embodiment of the present invention.
Figure 12:
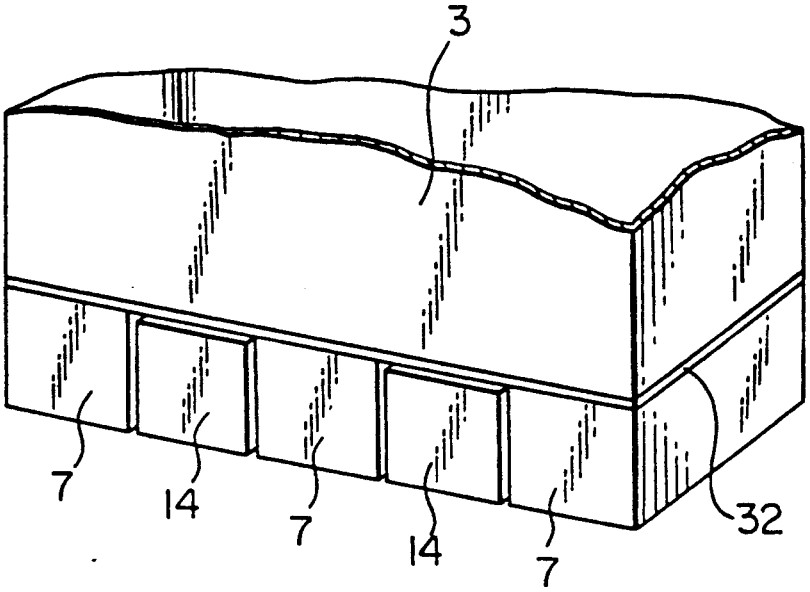
FIG. 12 is a fragmental perspective view of the electromagnetic induction apparatus with sound absorbing elements shown in FIG. 11 assembled into the electromagnetic induction apparatus.

The configuration of the structural member 13 is not limited to the illustrated configuration and many modifications can be resorted to as long as the space 10 can be changed to have dimensions and configuration with which no resonance phenomenon occurs. FIGS. 11 and 12 illustrate one of such modifications in which a structural member 14 comprises a plurality of rectangular plates 14*a* arranged in a plane perpendicular to the longitudinal direction of the structural member 14 and a horizontal plate 14*b* supported by the plates 14*a*. The horizontal plate 14*b* is positioned to prevent the resonance within the space 10. It is seen that the vertical plates 14*a* close the space 10.

As has been described, the sound absorbing arrangement for an electromagnetic induction apparatus according to the present invention can suppress the noise generated in the space formed between the tank bottom plate reinforcing members and the floor surface with a simple structure without employing a large scale sound insulating facility such as a sound insulating wall by shielding the space with a sound shielding member or by disposing a sound supressing element in the space.

What is claimed is:

1. An electromagnetic induction apparatus comprising:

a support surface;

a tank having a bottom surface and containing an electrical device;

a plurality of support members attached to the bottom surface of the tank and supporting the weight of the tank on the support surface, the support members defining a chamber between the bottom surface of the tank and the support surface;

a sound suppressing plate having top and bottom surfaces and disposed in the chamber between the support surface and the bottom surface of the tank substantially parallel to and spaced from both the bottom surface of the tank and the support surface; and a plurality of support plates extending from the top and bottom surfaces of the sound suppressing plate and supporting the sound suppressing plate above the support surface.

2. An apparatus as claimed in claim 1 wherein the chamber has a longitudinal axis and the support plates are substantially perpendicular to the axis.

3. An apparatus as claimed in claim 2 wherein the chamber has an open end and one of the support plates substantially blocks the open end.

* * * * *